United States Patent [19]

Beatty

[11] Patent Number: 4,983,985

[45] Date of Patent: Jan. 8, 1991

[54] CELLULAR ANTENNA

[76] Inventor: Steve Beatty, 3750 Texas Ave., St. Louis Park, Minn. 55426

[21] Appl. No.: 312,728

[22] Filed: Feb. 21, 1989

[51] Int. Cl.[5] ..... H01Q 1/40; H01Q 7/00

[52] U.S. Cl. ..... 343/741; 343/864; 343/866; 343/873

[58] Field of Search ..... 343/741, 744, 702, 720, 343/812, 866, 873, 897, 803, 864

[56] References Cited

U.S. PATENT DOCUMENTS

| | | | |
|---|---|---|---|
| 2,763,003 | 9/1956 | Harris | 343/873 |
| 3,582,951 | 6/1971 | Altmayer | 343/744 |
| 4,160,978 | 7/1979 | DuHamel | 343/742 |
| 4,401,988 | 8/1983 | Kaloi | 343/700 MS |

FOREIGN PATENT DOCUMENTS

| | | | |
|---|---|---|---|
| 801036 | 7/1936 | France | 343/897 |
| 2408268 | 7/1979 | France | 343/741 |
| 139358 | 10/1979 | Japan | 343/702 |
| 87599 | 4/1956 | Norway | 343/803 |
| 652716 | 5/1951 | United Kingdom | 343/803 |

*Primary Examiner*—Michael C. Wimer
*Attorney, Agent, or Firm*—Hugh D. Jaeger

[57] ABSTRACT

A cellular antenna including a matching transformer section connected to a substantially rectangular member of braid. An off-center feed provides for an omnipolar radiation.

1 Claim, 2 Drawing Sheets

CELLULAR ANTENNA

BACKGROUND OF THE INVENTION

1. Field of the Invention

The present invention pertains to an antenna, and more particularly, an antenna for cellular telephones, such as hand-held telephones, briefcase telephones, and portable telephones. The antenna can also be placed onto a window of a vehicle.

2. Description of the Prior Art

Prior art antennas are vertically polarized and flexible which work properly only with a ground plane at the feed point. Other prior art antennas are coaxial dipoles providing for vertical polarization and transmission. These vertically polarized antennas do not respond to randomly polarized signals typically received in portable telephone environments. The whip antennas have less than an ideal efficiency.

The present invention overcomes the disadvantages of the prior art by providing an omni-polarized cellular antenna.

SUMMARY OF THE INVENTION

The general purpose of the present invention is to provide an omni-polarized antenna for cellular telephones.

According to one embodiment of the present invention there is provided a cellular antenna including a coaxial feed-line impedance transformer connected to a one wave length copper braid element assuming a substantially rectangular configuration. The antenna responds to signals of random polarization, preferably better than a vertical whip which tends to ignore horizontally polarized signals. There is additional capture area in excess of that of a whip antenna, and provides stronger signals to and from the radio. The low standing wave ratio transfers power more efficiently to and from the telephone and minimizes duplex desensing of the receiver.

Significant aspects and features of the present invention include an antenna with large capture area for high receiver sensitivity and high effective radiated power. The antenna works with randomly polarized signals in both the horizontal and vertical polarizations. There is an excellent impedance match to the telephone The antenna has a broad frequency band width, and is immune to proximity effects.

Having thus described the embodiments of the present invention, it is a principal object hereof to provide a cellular antenna.

One object of the present invention is to provide a cellular antenna for car telephones, such as portable telephones, hand-held telephones, and briefcase telephones.

BRIEF DESCRIPTION OF THE DRAWINGS

Other objects of the present invention and many of the attendant advantages of the present invention will be readily appreciated as the same becomes better understood by reference to the following detailed description when considered in connection with the accompanying drawings, in which like reference numerals designate like parts throughout the figures thereof and wherein.

DESCRIPTION OF THE PREFERRED EMBODIMENTS

Figure 1:
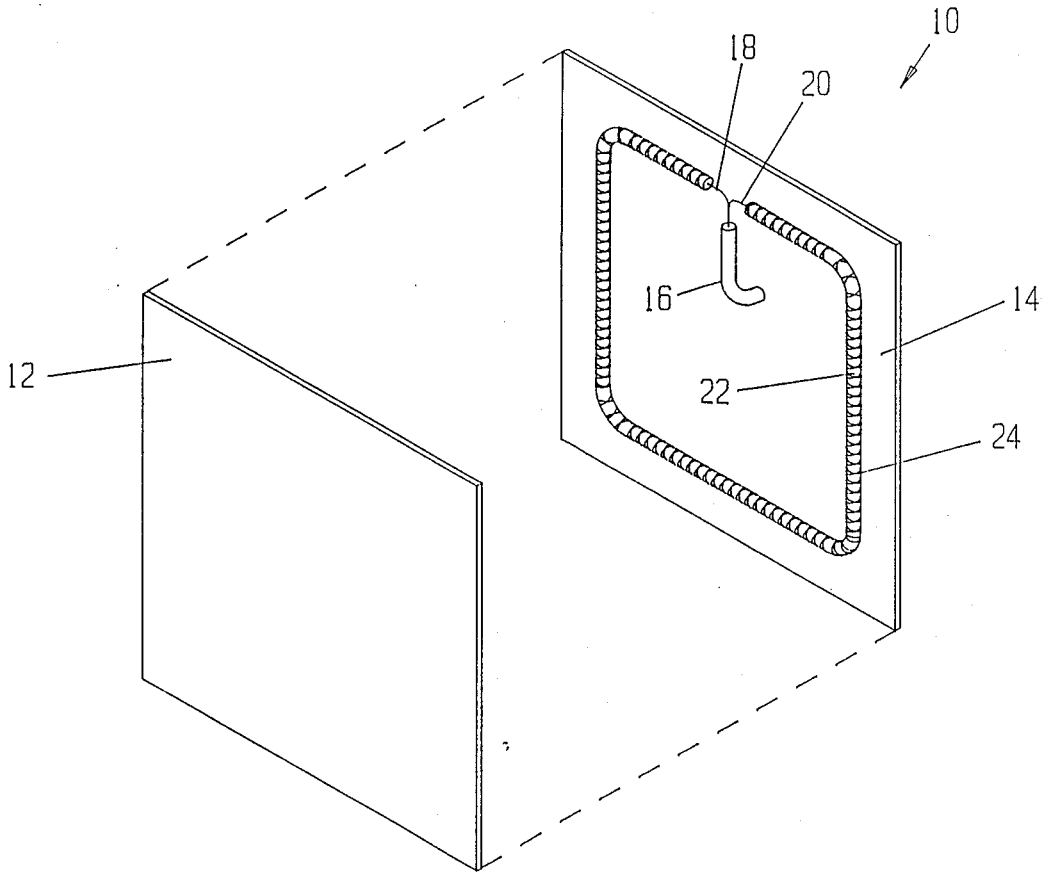
FIG. 1 illustrates a perspective view of a cellular antenna with a front panel of the antenna removed; and, FIG. 2 illustrates a cross-sectional view.
Figure 2:
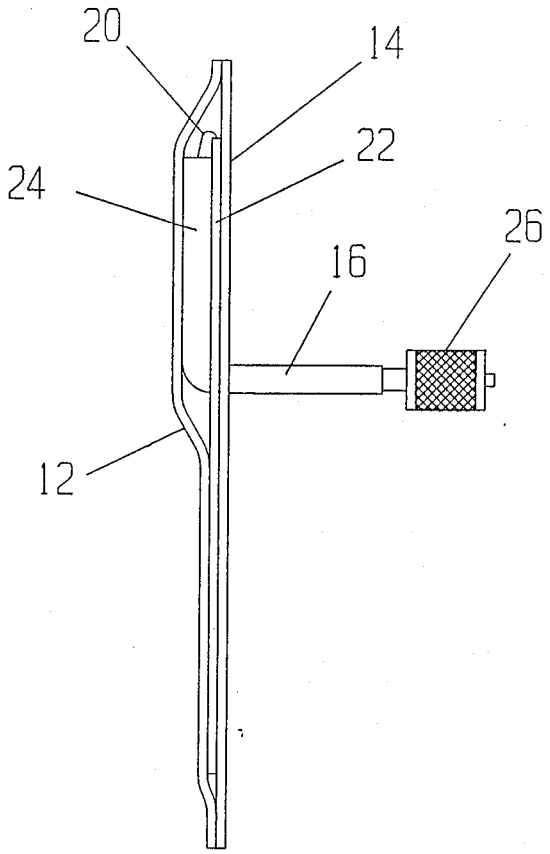

FIG. 1 illustrates an exploded perspective view of a cellular antenna 10, the present invention, including a front panel 12, a back panel 14, and a coaxial feed line transformer 16 extending through the back panel 14, and including an inner conductor 18 and an outer conductor 20. The front panel 12 is illustrated in a position removed from the back panel 14. A copper braid 22 of 3/32" wide copper braid forms the radiating element 24 and is positioned in a substantially rectangular configuration having dimensions of about 8 cm by 10 cm. The back panel 14 and front panel 12 are of a dimension of 12 cm by 14 cm. The length of the coaxial feed line transformer 16 is about 6 cm. The coaxial feed line transformer 16 has a 90 degree turn and terminates in a male mini UHF connector 26, as illustrated in FIG. 2, to mate with standard cellular telephone female connectors. The feed line transformer connects to each end of the braid at an off center point of one of the sides of the rectangular configuration to achieve omnipolarization. The antenna is intended for use in a cellular frequency range of 825 to 849 and 1870 to 894 megahertz. The antenna can also be used on other frequencies and other bands. The geometry of full wave radiator can assume any other predetermined geometrical configuration.

FIG. 2 illustrates a cross-sectional side view of the cellular antenna where all numerals correspond to those elements previously described.

MODE OF OPERATION

The cellular antenna 10 is installed to the portable telephone by attaching the feed line connector 26 to the coaxial connector on the telephone. Spacing between the cellular telephone and the antenna 10 is just under ¼ wave length, and a portion of the backwave signal is reflected in phase with the front wave, producing 6 decibels of forward gain. No other user controls or adjustments are required.

Various modifications can be made to the present invention without departing from the apparent scope hereof.

I claim:

1. Cellular antenna for 850 MHZ cellular telephone transceiver operation comprising:

a. a substantially rectangular configuration of copper braid full wave loop of approximately 8 cm by 10 cm with an electrical connection at an off center point of said rectangular configuration between ends of said braid;

b. a back panel supporting said copper braid;

c. a coaxial feed line transformer of approximately 6 cm in length with a 90 degree bend in a center portion of said length thereof electrically connected at one end to said ends of said braid at said off center point of a long leg of said rectangular configuration of said copper braid with a male UHF connector at an other end; and, d. front panel of the same size of said back panel encompassing said rectangular configuration of said copper braid whereby said coaxial feedline transformer matches said antenna to said cellular telephone transceiver.

* * * * *